United States Patent [19]

Randolph, Sr.

[11] 4,002,049

[45] Jan. 11, 1977

[54] FORMING TOOL FOR USE IN A DIE ASSEMBLY

[75] Inventor: Allan Emerson Randolph, Sr., Kettering, Ohio

[73] Assignee: Ready Stamping System, Inc., Dayton, Ohio

[22] Filed: June 9, 1975

[21] Appl. No.: 585,066

[52] U.S. Cl. ..... 72/388; 72/313

[51] Int. Cl.[2] ..... B21D 5/04

[58] Field of Search ..... 72/312, 313, 382, 387, 72/388, 381, 383

[56] References Cited

UNITED STATES PATENTS

| | | | |
|---|---|---|---|
| 2,348,957 | 5/1944 | Carvalho | 72/313 |
| 3,400,568 | 9/1968 | Brandner | 72/387 |
| 3,621,704 | 11/1971 | Schaeffer | 72/383 |

*Primary Examiner*—Lowell A. Larson
*Attorney, Agent, or Firm*—Jerome P. Bloom

[57] ABSTRACT

A forming tool comprising a relatively rigid shank portion or holder mounting in bearing relation thereto and for limited rotation thereon an operating head. In the preferred embodiment illustrated the operating head is in the nature of a generally cylindrical body having a V-shaped notch. The formation of the notch in the cylindrical body produces thereon a pair of laterally spaced bearing surfaces for application to material to be worked, one of which functions as a fixing means and the other of which functions as a bending means.

9 Claims, 8 Drawing Figures

FORMING TOOL FOR USE IN A DIE ASSEMBLY

BACKGROUND OF THE INVENTION

This invention relates to means for bending sheet or like material which precludes damage to the part being formed.

In today's industrial operations many parts are formed in a stamping operation in a press. For such purpose the press is provided with the required set of tools and dies. The tools and dies are appropriately mounted to the ram or the bed of the press and one thereof is reciprocated relative the other as sheet or like material, from which a part is being formed, is fed therebetween. In many instances one or more of the mating tools and dies is designed to bend, from the plane thereof, a portion of the sheet material. In accordance with prior art practice, mating tool and die elements used for such purpose are so arranged that the bending tool is a rigid punch-like element mounting perpendicular to the sheet material. In most cases this rigid element has an operating surface including a portion which, as the press is operated, moves in a vertical plane adjacent and parallel to a cooperating surface of a related forming die. An inherent result of its use is the production of shear forces having side effects tending to damage, and in some cases irreparably damage, the part being formed.

Another undesirable effect of using bending apparatus of the prior art is that the nature thereof and the manner of its application is such to introduce residual stresses in the displaced portion of the sheet material. This results in "springback." When this occurs, as is often the case, a secondary forming operation is required to return the displaced portion of the sheet material to the position in which it must be set.

The incidence and degree of springback is particularly difficult to anticipate. This is due to the fact that it depends both on the ratio of the bend radius to the thickness of the stock to which the bend is applied and the tensile strength and unit elongation of the material being bent. As a result for the most part, the design of tooling for bending procedures has been a matter of trial and error, with no guarantee as to results.

In any event, it has been found the bending of portions of sheet material usually requires a secondary forming operation due to the springback. One such secondary forming operation is commonly called "side cam tooling." Another is called "coining." Either operation adds to the forming costs and incurs the possibility of causing undesirable thinning and stressing of the formed material.

Thus, in accordance with prior art practice bending is not engineered but merely contrived, in a relatively uneconomical fashion, and with means and methods lacking the characteristics of precision and oftentimes producing rupturing, skidding and stretching of the sheet material to which the operation is applied.

In some cases use of the prior art apparatus dictates that the press employed must have a higher tonnage than would normally seem reasonable. Die costs are also increased since the bending operation in accordance with prior art practice necessitates substantial anchoring means to offset the possibility of a skidding of sheet material on which the bending operation is being performed.

SUMMARY OF THE PRESENT INVENTION

The present invention provides simple and effective means for avoiding the above noted problems one or more of which are normally incident to a bending operation in a press or a comparable machine structure.

The apparatus of the invention, moreover, provides means and methods for effecting a bending operation which are economical to employ, more efficient and satisfactory in use and adaptable to a wide variety of applications.

In its preferred embodiment the bending tool of the present invention is roller type device which in a closing action of a press rotates and functions in conjunction with a forming die to effect a smooth bending with a minimal introduction of stress in the material to which it is applied.

In the example illustrated, the bending tool comprises a generally cylindrical element having a longitudinally directed V or pie-shaped notch. As a press in which this device is embodied closes the radially outermost edges of the notch provide circumferentially spaced lines of contact with longitudinally spaced portions of the strip or sheet material from which a part is to be formed. One line of contact of the roller is referenced to a portion of the sheet material which is backed by the related forming die while the other thereof engages the unsupported portion of the sheet material to be bent. On closing of the press, the roller moves in a rotating path to bend the unsupported portion of the sheet material out of its normal plane to assume and set in whatever angular position is dictated by the complementary forming die means. A proper set is insured since the nature of the tool permits the simultaneous application of both vertical and lateral forces to the engaged portion of the work material.

In the preferred embodiment of the bending tool just described, the angle formed by the side walls of the notch will be determined by the angle to be assumed by the bent portion of the work material. Means are included to control the rotation of the bending tool to insure the limits of its rotation will be such to not only minimize the introduction of stress in the sheet material on which it operates but to achieve a precise control of the set.

It will be obvious, of course, that the bending tool herein described may be split into plural components and have other geometric form and still retain the concepts of the present invention. Accordingly, the description of the preferred embodiment of the invention is not to be considered as limiting but merely illustrative in context.

An object of the invention is to provide a new and improved forming tool useful in a bending operation.

A further object of the invention is to provide a tool for bending sheet or like material which in the function thereof rotates.

An additional object of the invention is to provide a bending tool for use in a machine such as a press which depends for its function on a rotating movement thereof in the course of closing of a die assembly embodied in the press.

An additional object of the invention is to provide bending apparatus possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein are shown some but not necessarily the only forms of application of the present invention, FIGS. 1 through 5 are schematic views showing the progressive movement of a forming tool in accordance with the present invention to achieve a bending operation in a press;

Like parts are indicated by similar characters of reference throughout the several views.

DESCRIPTION OF A PREFERRED EMBODIMENT AND APPLICATION OF THE PRESENT INVENTION

Figure 1:
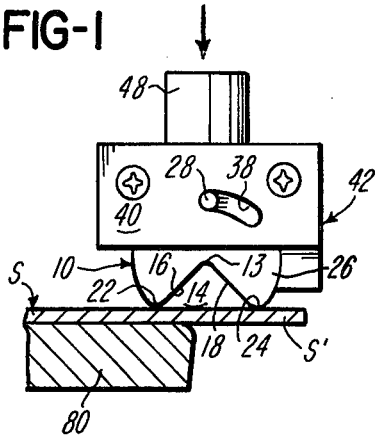

As shown in the preferred embodiment illustrated in the drawings, the invention features a bending or forming tool the operating head 10 of which is an element having a generally cylindrical shape, the peripheral surface 12 of which is intercepted by the formation therein of a longitudinally extending V-shaped notch 14. In the example illustrated the notch 14 is defined by side wall surfaces 16 and 18 forming an angle therebetween which is slightly less than 90°. It should be observed that the innermost or apex surface 13 of the notch 14 falls short of the central or longitudinal axis of the cylinder 10 but is in a line essentially parallel thereto.

The outermost extremities of the side walls 16 and 18 of the notch 14 merge with the cylindrical outer surface 12 of the element 10 by means of radiused wall portions 20. The latter are comprised of generally parallel line formations which, as will be further described, define a fixing edge 22 and a bending edge 24 on the operating head 10.

Projected from and perpendicular to each of the respectively parallel end wall surfaces 26 of the operating head 10 is a pin 28. The pins 28 are in a line parallel to the central longitudinally extending axis of the operating head 10 and in a plane which they commonly occupy together with the line defining the apex 13 of the notch 14. It should be noted that whereas the apex 13 of the notch 14 is relatively closely adjacent to the central axis of the operating head 10, the line occupied by the pins 28 is relatively remote therefrom, the pins positioning in adjacent and closely spaced relation to the outer surface 12 of the element 10.

As seen in FIGS. 1 through 5 and 8, the pins 28 project through and bear in arcuate slots 38 formed in plates 40 releasably fixed in connection with opposite outer sides of a device 42 forming a holder for the operating head 10.

Viewing the holder 42 with respect to its orientation as shown in FIGS. 1 through 6 of the drawings, its lower end is formed with a longitudinally extended transversely arcuate groove 44. The groove 44 is formed to bearingly nest somewhat more than 180° of the circumferential extent of the outer surface 12 of the operating head 10. It will be seen that as the plates 40 are mounted to the holder 42 they position in partially capping relation to the respective ends of the groove 44 and in a manner to laterally contain the operating head 10 as the pins 28 thereof project through and bear in the slots 38. It will be seen also that the mount of the operating head 10 as thus provided dictates that the notch portion 14 thereof will position below the lower edge of the plates 40 and in an exposed relation to the work material to which the same is to be applied in a bending operation.

Figure 6:
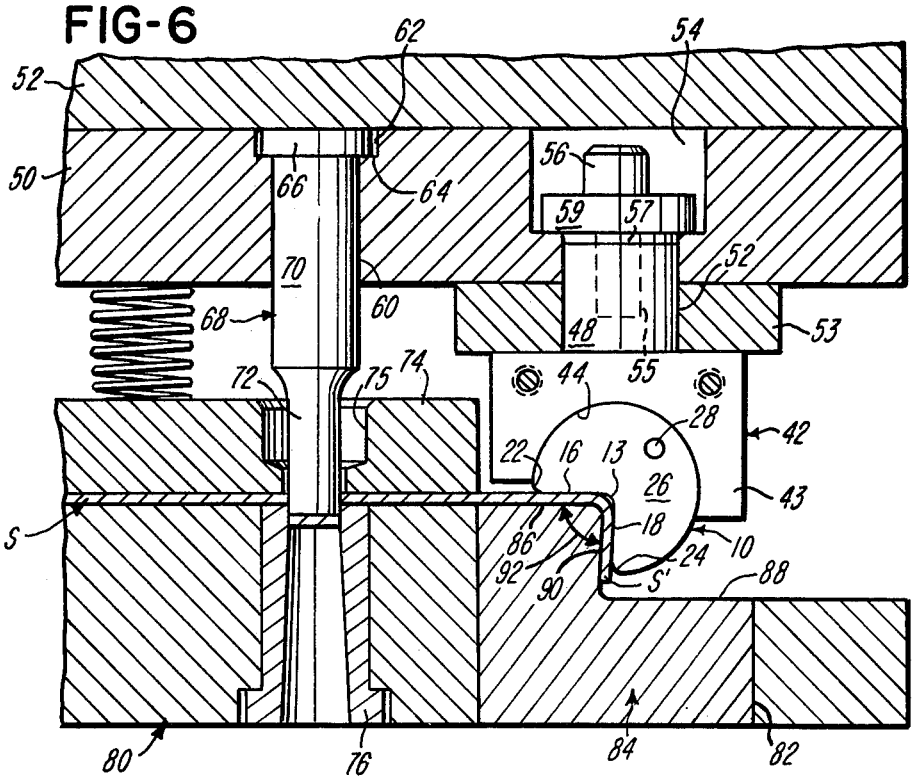
FIG. 6 is a fragmentary cross-sectional view of a die assembly as applied in a press showing the use of the forming tool exhibited in FIGS. 1 to 5.

Viewing FIG. 6 of the drawings wherein one end of the operating head 10 and the holder 42 is exposed by removal of a plate 40, it may be seen that to one side of the element 10 the lower end of the holder 42 has a portion 43 which depends to a greater extent than the lower end portion of the holder 42 to the opposite side of the element 10. The net effect of the dependency of the portion 43 is that it extends the arcuately formed encompassing wall surface on the holder which defines the groove 44. It is in this manner that the arcuate bearing surface providing the groove 44 is enabled to seat a circumferential extent of the surface 12 of the operating head 10 which is greater than 180°. The benefits of this construction will be further observed as the description of the use and application of the invention continues.

In peripheral outline the body of the holder 42 is basically rectangular in configuration and the uppermost surface of this rectangle includes a relatively centered and perpendicularly projected pin-like shank portion 48 which facilitates the mount thereof.

Referring to FIG. 6 of the drawings which illustrates the invention tool as a part of a die assembly applied in a press, the composite structure of the holder 42 and the operating head 10 is mounted to a tool retainer 50 in connection with the upper die shoe 51 of the press. Since the details of the press are not necessary for an understanding of the invention, they are not otherwise illustrated. In its assembly, the shank portion 48 of the holder 42 is first thrust through an annular washer-like element 53 as it is introduced to the lower end of an aperture 52 in the tool retainer 50. A thin ring-shaped washer 57 is then placed on the uppermost end of the shank porton 48 to fill the aperture 52 to the level of the base of an upper counterbored portion 54 thereof which opens to the undersurface of the die shoe 51. As so positioned, the washer 57 rims the opening from a central, axially directed, tapped recess 55 formed in the upper end of the shank portion 48. The counterbore 54 produces an annular shoulder at its base which seats the peripherally projected portion of a further ring-shaped washer 59, the inner periphery of which overlaps the outer periphery of the washer 57. A headed screw 56 is then thrust through the washers 59 and 57 and into the tapped recess 55 to effect a threaded engagement with the shank portion 48. By such means, the holder 42 is clamped in fixed connection with the tool retainer 50. The latter will be suitably fixed, in turn, to the die shoe 51 (or any equivalent thereof which may be placed in connection with the ram of the press in which the bending tool of the invention is embodied).

The fragment of the tool retainer 50 is shown in FIG. 6 to include a further aperture 60 positioned in parallel spaced relation to the aperture 52. The uppermost end of the aperture 60 which opens to the undersurface of the die shoe 51 is expanded by a counterbore 62. This produces therein an annular shoulder 64 which seats the peripherally projected flange portion 66 of the head of a conventional perforator type punch 68. The shank 70 of the punch 68 extends through the aperture 60 to dispose the punch operating end 72 in a dependent perpendicularly projected relation with respect to the retainer 50 and the undersurface of the die shoe 51, against which its head is seated and by which the head is backed.

In this instance the punch 68 is merely included as illustrative of a number of tools which may, if desired, be mounted to and held by the retainer 50 together with the bending tool of the invention, to form part of an otherwise conventional die assembly in a press.

Further illustrated in FIG. 6 is a conventional stripper plate 74 including an aperture 75 accommodating and guiding the operating end of the punch 68 in the course of its function to cooperate with a vertically aligned tubular die button 76. The latter is shown as press fit in an aperture 78 formed in a lower die plate 80. In practice the die plate 80 will be fixedly and releasably secured on and in connection with a lower die shoe and/or the bed of the press (not shown) in which the illustrated die assembly is embodied. A spring 80 is shown as interposed between the retainer 50 and the plate 74 to diagrammatically illustrate the inclusion of conventional means to suspend the stripper plate from the die shoe 51 and bias the same to serve its normal function in reference to stock S which may be positioned in its path, on the die plate 80.

The die plate 80 as shown in FIG. 6 will embody die components to function mutually with the operating ends of whatever tools are embodied in connection with the tool retainer 50. Accordingly, included in an aperture 82 in the lower die plate 80 is a forming die 84 which lies in the vertical path of the operating head 10 as a press in which the forming tool and die are embodied is closed. The uppermost surface of the forming die most adjacent the operating head 10 is stepped and in the instance illustrated comprised of an uppermost surface portion 86 and a relatively dropped or lowermost portion 88. The adjacent edges of the surface portions 86 and 88 of the forming die are joined by a generally vertical surface 90 which is slightly inclined to make an angle of less than 90° with each of the surfaces 86 and 88. Attention is directed to the fact that in the practice of the invention this angle identified in the drawings by the numeral 92 will be slightly greater than the angle defined by the side walls 16 and 18 which form the notch 14.

Attention is now directed to FIGS. 1 through 6 of the drawings which generally diagrammatically illustrate primarily the manner in which the bending tool of the invention functions in closing of the press in which the die assembly of which it forms a part is embodied. For purposes of description of the function here involved, let us assume that the stock S is fed over the upper surface of the die plate 80 from right to left and its form is that of a section of sheet material which is to be suitably configured by the tools of the die assembly to form a part to be applied to an article of manufacture. In the formation of this part the objective, as shown, includes a bending of one edge portion thereof, in this case the right edge as illustrated in FIG. 6.

With the foregoing in mind, attention is directed to FIGS. 1 through 5 of the drawings to see precisely what will happen as the bending tool of the invention comprised of the holder 42 and the operating head 10 moves to function in the closing of the press. It will be obvious that the stock S will position in a plane determined by the upper surface of the die 80 and the surface portion 86 of the forming die 84, which will leave a predetermined edge portion S′ of the stock in a relatively unsupported parallel spaced relation to the surface 88 of the forming die in the first instance. Attention is directed to the fact that the generally cylindrical operating head 10 will be bearingly related to the surface defining the groove 44 in the bottom of the holder 42, which surface is extended by the dependent portion 43 of the holder. It should be observed that there is no fixed pivot connection as between the operating head and its holder but rather a shifting pivot connection through the medium of the pins 28 riding in the arcuate slots 38 in the plates 40. The position and arrangement is such, nevertheless, to firmly seat the operating head 10 against its bearing surface. Since the bearing relation of the operating head is relatively free and its notch 14 will dispose lowermost by reason of the limitations imposed on the pins 28 by the form of the slots 38, as one or both of edges 22 and 24 at the outer edges of the notch 14 engage the upper surface of the stock, the free bearing relation of the head 10 will insure an orientation thereof that both edges will in the first contact come to a balanced engagement with the upper surface of the stock. Under the circumstances, as seen in FIG. 1, the fixing edge 22 will be engaged with the stock portion S which is supported and backed by the surface 86 of the forming die whereas the bending edge 24 will engage the stock portion S′ which is unsupported. With the edges 22 and 24 reaching this mutually contacting position with reference to the stock S, the pins 28 will be in the upper limits of the arcuate slots 38, at which point they will lie in a plane commonly occupied by the central longitudinal axis of the shank portion 48 and the notch apex 13.

Figure 2:
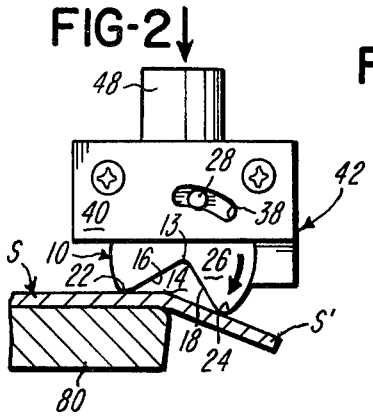
Figure 3:
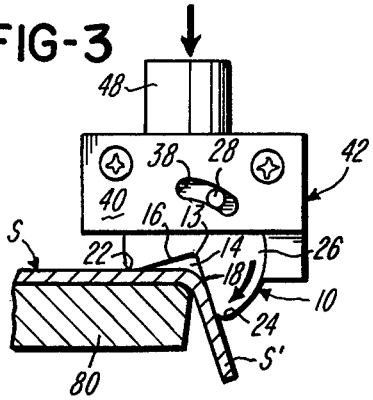
Figure 4:
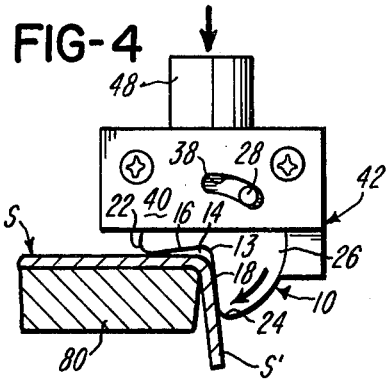
Figure 5:
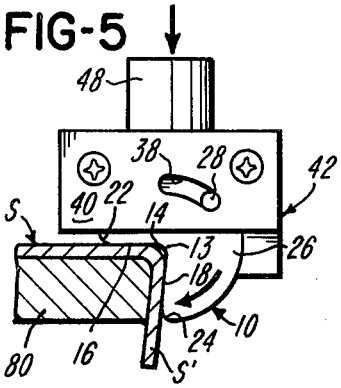

Referring now to FIG. 2, it may be seen that as a consequence of the obviously vertical movement imposed on the holder shank portion 48 in the closing of the press, and the fact that the head 10 by reason of its cylindrical configuration may move relative its holder, the resultant effect is that the fixing edge 22 of the operating head will roll, in the example illustrated to produce a clockwise rotation of the head in the closing of the press. This is due to the fact there is resistance to the downward movement of the fixing edge imposed by the surface 86 of the forming die while the bending edge is relatively unsupported. Thus, in the closing of the press the vertical forces applied are directed through the rotating head 10 which in turn produces a controlled application of rotating force patterns comprised of both vertical and lateral components. These rotating force patterns are applied to the stock portion S′ which is consequently progressively bent towards its desired position. As seen in FIG. 3, at a particular point in the closing operation of the press the side wall 18 of the notch 14 in the head 10 will assume an approximately parallel bearing relation to the stock portion S′, through the medium of which there is a firm and gradual movement of the stock portion S′ towards an abutment with the surface 90 of the forming die 84. As will be obvious, the limit of rotating movement of the head 10 is determined, in accordance with the application illustrated, by a seating of the pins 28 in the lowermost end of their slots 38. It will be obvious that in the final closing stages of the press that the radiused fixing edge 22 will be extended to utilize more and more of its parallel line composition as a bearing surface. As seen in FIGS. 4 and 5, coincident with the pins 28 reaching their lower limits of travel in the slots 38, a substantial portion of the wall surface 16 of notch 14 will be in bearing engagement with the stock S, at the portion thereof backed by the surfaces 86 of the forming die which is immediately adjacent the surface 90.

It should be clearly evident that by virtue of use of the notched rotating operating head 10 that in the final fixing or setting of the bent portion of the stock (S′) both this stock portion as well as the stock portion adjacent thereto abutted by the surface 16 is firmly and positively contained in a clamped relation to the forming die. This insures that the stock portion S′ will be precisely set.

Attention is directed to the fact that the angle of the notch 14 is slightly less than that between the surfaces 86 and 90, by reason of which it is insured that the stock portion S′ is firmly secured in the conclusion of the press closing operation and in a manner to "set" this portion as required. In this fashion, forces are exerted to effect a proper set of the stock portion S′ which substantially eliminates any chance of spring back and completely avoids the need for a secondary setting action with reference to insuring the proper orientation of the stock portion S′.

Of course, in the closing of the press, other tools, if any, embodied in connection with the die assembly including the forming tool will simultaneously serve their function.

It will be seen from these drawings that the dependent portion 43 on the holder serves a highly useful function in that it not only provides a continuance of a bearing surface for the head 10 but a substantial backing for the head 10 which enables an optimal application of the various forces applied to the stock by virtue of the rotating head function in closing of the press. The dependent portion 43 of the holder serves to dissipate to a considerable extent various stresses involved in the forming function.

It will be seen that the head 10 may have its periphery suitably formed in any fashion as required for a particular application. Moreover, depending on the application the form and limits of the arcuate slots 38 may be suitably altered. The only criteria in this respect is that the pins in the slots involved will have such a relation to dictate the proper degree and limits of movement of the forming portion of the head.

Figure 7:
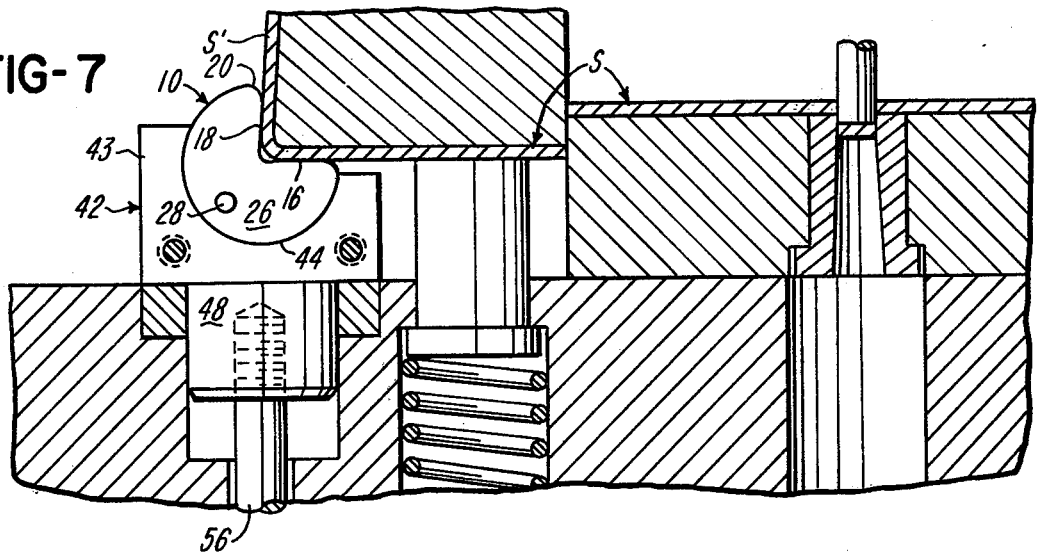
FIG. 7 is a further showing of a fragment of a die assembly in a press, illustrated in cross section, showing the forming or bending tool of FIGS. 1 to 5 as used in connection with a die plate in a combined sever end bend operation.
Figure 8:
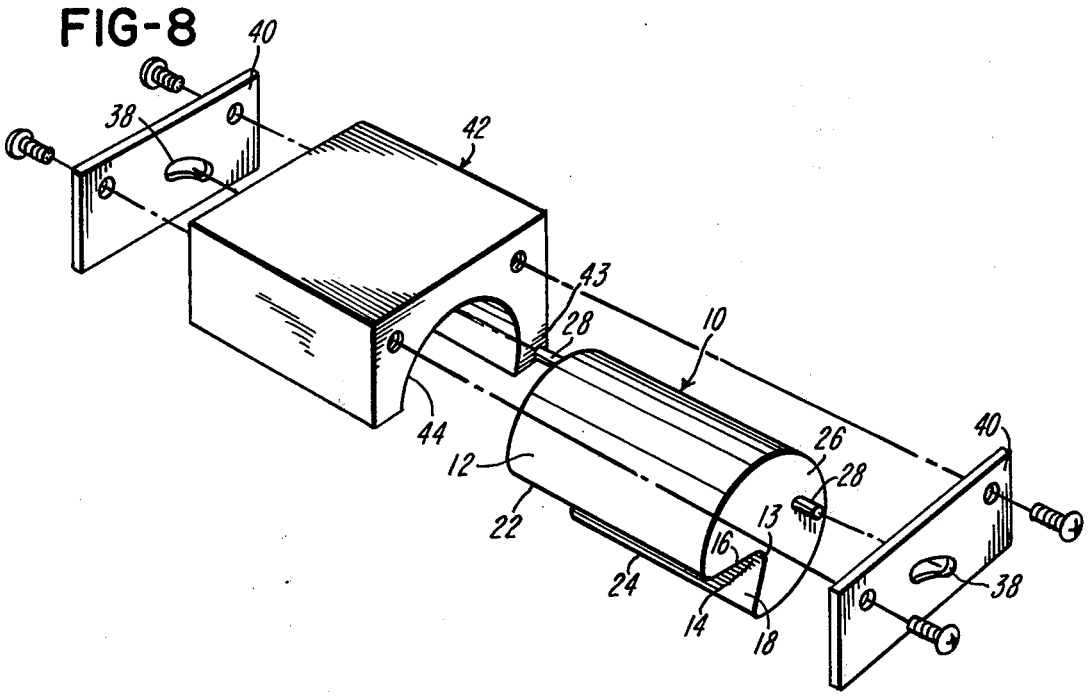
FIG. 8 is an exploded view, in perspective, of the bending tool of the invention as mounted to its holder.

FIG. 7 of the drawings is merely included to show that the forming tool of the invention may be reversely oriented and applied in connection with a lower die plate in a combined sever and bend operation such as diagrammatically illustrated. Since the operation of the forming tool will be identical to that previously described and the elements of the fragment of the die assembly illustrated in FIG. 7 will be well understood as to their functions by one versed in the art, it does not appear that detailed description thereof is necessary. It is noted that the operating head of the tool and its holder as well as the stock portion to which it applies are identified in the same fashion as they were in reference to the showing in FIGS. 1 through 6 of the drawings.

In utilizing the invention structure one can, if desired, design the forming tool configuration and the related die surface to produce a deliberate overbend, to a slight degree, of the portion of the material being worked. This may give added insurance against residual forces which might tend to produce a slight spring back after being subjected to a working in accordance with the invention. In any case, it is only by reason of utilizing the roller type operating head on a forming tool in accordance with the invention that a rotary force pattern is applied which produces both vertical and lateral force segments in a manner that they are smoothly imposed to minimize the normal undesirable effects of bending material in a press or like structure.

The net effect of the use of the invention is to avoid the various types of damage so frequently imposed on material being subjected to a bending operation in accordance with the teachings of the prior art. Moreover, it will be seen from the foregoing description that the invention insures against a slipping of the material being worked in the course of its being formed in a press.

An indirect consequence of the use of the invention is that the firm control of stock being worked enables a reduction in the tonnage requirements of the press supplied to any particular forming operation.

In summary, the invention structure enables a smooth progressive bending action in its operation which is in distinct contrast to that achieved in use of prior art structure. The latter has depended for its function on the application of a sudden deforming pressure the nature of which produces, inherently, shock, fracture, shear and stretch of the material being worked in a considerable number of instances. A consequence of the smoothness of the bending procedure in using the forming tool of the invention is a reduction of wear of the parts with which it is embodied in a die assembly. It is to be noted also that in the use of the present invention there will be no problems due to variation of stock thickness. The nature and character of the invention structure enables that maximum and minimum tolerances in stock thicknesses may be compensated for simply by resetting the press stroke to achieve a proper shut height of the involved die. Moreover, by simply providing an option as to the dimension and configuration of the operating head, one can minimize the capitol investment in forming tools.

Thus, the invention provides a unique and novel bending tool the operating head of which functions as a roller and has a shifting pivot connection to its shank portion which in the instance illustrated is comprised of the holder 42 and its integrally connected pin-like structure 48.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A forming tool comprising a holder an exterior surface portion of which includes a groove the base of which is arcuately configured and provides a bearing surface for an operating head in the form of a roller device, said roller device including a longitudinally extended radially directed V-shaped notch the side walls of which are outwardly divergent, define an angle which is less than that to be formed in the work material to which it is applied and provide circularly spaced edge portions at their outer extremities for contact with the work material, said roller device being mounted for free rotation with respect to said holder in response to a bearing of one of said spaced edge portions against a supported portion of the work material and a bearing movement of the other of said spaced edge portions on an unsupported portion of the work material whereby to bend a portion of said material to a predetermined angle, and means providing abutment surfaces which determine the limits of rotation of said roller device in the application thereof to work material.

2. A forming tool as in claim 1 characterized in that said holder includes at one end thereof a shank portion for mounting thereof to a tool retainer and at the other end thereof said head which in the projected extremity thereof is formed with said groove, providing thereby that said tool may be mounted for vertical movement, with said roller device and said notch therein presented outwardly of its projected extremity.

3. A forming tool according to claim 2 wherein said means providing abutment surfaces are arranged to define limits of rotation of said roller device providing for rotary movement of said other of said spaced edge portions through a distance greater than 90° from the plane of the work material against which said spaced edge portions are abutted in the initial contact thereof with said material in the operation of said tool.

4. A forming tool as in claim 1 characterized in that said means providing abutment surfaces are connected to said holder and said roller device and include means mounting a pin and means defining a slot within which the pin moves between abutment surfaces provided at remote end portions of said slot.

5. A forming tool as in claim 4 characterized in that said roller device incorporates said means mounting a pin in each of the respective ends thereof and guide plate means mounted to said holder close the respective ends of said groove and provide therein, in each case, a slot which freely receives the pin in connection with the adjacent end of said roller device whereby to incorporate in connection with said roller device and said holder the said means providing said abutment surfaces.

6. Apparatus including the forming tool according to claim 1 comprising a ram and a bed arranged for relative separating and approaching motion, one thereof mounting said holder and the other thereof providing a forming die generally vertically aligned with and in cooperating relation to said operating head to mount the work material for producing a bend therein under the influence of the application of said tool, the angularity of the forming surface of said die as related to the angularity of the sides of said notch being such to provide that in the application of said operating head to the work material to achieve a forming thereof the work material is bent to a greater degree than prescribed for the final form thereof to allow for the spring back inherent in the material to produce therein the end configuration desired.

7. Apparatus as in claim 6 characterized in that said forming die has its forming surface portions define therebetween an angle which is less than 90° and said side walls of said notch define therebetween an angle which is also less than 90° to provide thereby for a right angle forming of a portion of the work material the final form of which is achieved, inherently, by spring back of the work material.

8. A forming tool according to claim 6 wherein the working surface portions of said forming die and the side wall portions of said notch respectively define therebetween an angle which is slightly less than the desired angular configuration to be formed in said work material to provide for spring back inherent in the work material to finalize the form thereof subsequent to the forming operation.

9. A forming tool including a holder having a projecting shank portion by which the tool may be installed of one of opposing vertically spaced die elements, the end surface of said holder remote from said projecting shank portion being formed with a transversely extended groove the base of which is arcuate in cross section, the respective ends of said groove opening from opposite end walls of said holder, a cylindrical roller element nested in said groove and mounted so as to be freely rotatable therein, said roller member having a diameter to provide that a peripheral segment thereof projects from said groove and is formed with a radially directed V-shaped notch in its outer periphery, guide plate means mounted to said opposite end walls of said holder in a substantially closing relation to the ends of said groove and means being provided to define a pin-slot connection between said guide plate means and the ends of said roller member, said connection permitting the relatively free rotation of said roller member within the limits of said slot.

* * * * *